United States Patent [19]

Tanaka et al.

[11] Patent Number: 4,564,591

[45] Date of Patent: Jan. 14, 1986

[54] SILVER HALIDE COLOR PHOTOGRAPHIC MATERIAL

[75] Inventors: Shigeo Tanaka; Kaoru Onodera, both of Odawara, Japan

[73] Assignee: Konishiroku Photo Industry Co., Ltd., Tokyo, Japan

[21] Appl. No.: 715,035

[22] Filed: Mar. 21, 1985

Related U.S. Application Data

[63] Continuation of Ser. No. 446,162, Dec. 1, 1982, abandoned.

[30] Foreign Application Priority Data

Dec. 2, 1981 [JP] Japan ..... 56-194782

[51] Int. Cl.[4] ..... G03C 1/02; G03C 1/28

[52] U.S. Cl. ..... 430/567; 430/603

[58] Field of Search ..... 430/564, 567, 603, 604, 430/605, 940

[56] References Cited

U.S. PATENT DOCUMENTS

| | | | |
|---|---|---|---|
| 3,206,313 | 9/1965 | Porter et al. | 430/603 |
| 3,761,266 | 9/1973 | Milton | 430/599 |
| 3,935,014 | 1/1976 | Klotzer | 430/567 |
| 4,070,190 | 1/1978 | Friedrich et al. | 430/564 |
| 4,094,684 | 6/1978 | Maskasky | 430/567 |

FOREIGN PATENT DOCUMENTS 1027146 4/1966 United Kingdom .

*Primary Examiner*—Won H. Louie

*Attorney, Agent, or Firm*—Jordan B. Bierman

[57] ABSTRACT

Silver halide color photographic material comprising a support and at least one emulsion layer thereon, the emulsion layer containing silver halide grains comprising core particles of high chloride content and a silver halide coating layer on the core particle. The coating layer is primarily silver bromide and the combined silver halide content of the core particles and the coating thereon is 90 to 99.5 mol % silver chloride and 0.5 to 10 mol % silver bromide.

12 Claims, 3 Drawing Figures

SILVER HALIDE COLOR PHOTOGRAPHIC MATERIAL

This application is a continuation, of application Ser. No. 446,162, filed Dec. 1, 1982, abandoned.

This application claims priority under 35 U.S.C. Section 119 of Japanese application No. 194782/1981, filed Dec. 2, 1981.

The present invention relates to a silver halide color photographic material formed by coating an improved photographic silver halide emulsion or emulsions of high chloride content.

For the silver halide color photographic material, silver iodobromide or silver chlorobromide whose principal ingredient is silver bromide has been used since comparatively high sensitivity is readily available with it.

On the one hand, it is known that the silver halide emulsion of high chloride content can be processed faster as compared to the above mentioned emulsion comprising silver bromide as the principal ingredient, for which several possible reasons including higher solubility of silver chloride may be thought of. Further, since the silver chloride absorbs visible rays of light almost nothing, any contrivance to substantially lower the blue sensitivity of green sensitive and red sensitive emulsions as compared to that of blue sensitive emulsion becomes unnecessary. This makes it possible to remove a yellow filter layer from certain kinds of color photographic materials and thereby eliminate colloidal silver that causes fogging, etc. in adjacent emulsion layers. In addition, certain kinds of color photographic materials maintain their blue sensitivity at dominantly high levels by using an emulsion of larger grain sizes for the blue sensitive emulsion as compared to others but, as is known, use of a silver halide emulsion of high chloride content makes it possible to replace such larger grains with smaller ones, so defects that are caused by use of an emulsion of larger grains, for example, tendency of fogging, lower developing rate, etc., may be moderated.

However, it is known that the silver halide emulsion of high chloride content is liable to fog and exhibits inferior stability in storage. Further, studies of the present authors and their followers revealed that the currently practiced processing making use of an automatic processor, in which contamination of each bath with small volumes of solutions from other baths is unavoidable, has such a defect that contamination of the developer even with a small amount of thiosulfate ion used in the fixing bath causes remarkable increase in fog. Further, they discovered a phenomenon that in chemical ripening of the silver halide emulsion of high chloride content making use of a sulfur sensitizer such as sodium thiosulfate, initially sensitization is limited only to the low density region of characteristic curve and it gradually extends to the high density region to recover the gradation. The maximum sensitivity is reached in almost the same timing as the gradation is recovered. Around the same timing, however, fog starts to increase. As a result, insufficient chemical ripening results in lower sensitivity with improper gradation while excessive chemical ripening leads to pronounced fog, so the degree of chemical ripening that is of practical use has been limited to a very narrow range. Further, since the above chemical ripening has a long initial induction period followed by a later sharp change, it has been very difficult to stop the chemical ripening at such a stage that its degree is within the very limited region of practical use. Beside, with an emulsion comprising grains of comparatively large grain sizes, the intensification of fog starts at an earlier timing, so there is sometimes no region of practical use for the degree of chemical ripening.

Klein, et al. discloses in Japanese Patent Examined Publication No. 18939/1981 that use of laminated type silver halide grains that comprise silver chloride grains covered with silver bromide or silver bromide grains covered with silver chloride gives an emulsion that is endowed with merits of both silver chloride and silver bromide. Particularly, it is stated therein that the former laminated type silver halide grains tend to less increase in fog when exposed to the ray of safe-light than silver bromide while suppressing the high inclination of silver chloride to fog and improving the comparatively low stability of the same.

It is noted however that an emulsion exhibiting a desirable performance cannot be prepared just by giving a prescription that formation of silver chloride grains should be followed by covering with silver bromide. Selection of a proper quantity of silver bromide for covering makes it possible to not only suppress the high inclination of the silver halide emulsion of high chloride content to fogging and improve its stability in storage but minimize the lowering in the developing rate of silver chloride that appears as a tradeoff of the above improvements of weak points, improve the sensitivity solving the problem accompanying the chemical ripening of silver chloride and increasing the reproducibility of the chemical ripening process, and suppress remarkable increase in fog that may otherwise appear in case of contamination of the developer with sodium thiosulfate. Japanese Patent Examined Publication No. 18939/1981 mentions nothing about a possibility of improving those defects of the silver halide emulsion of high chloride content. The reproducibility in performance, the suitability of quick process and automatic process are increasingly emphasized today, so those defects of the silver halide emulsion of high chloride content might be stated almost fatal. This invention provides the method that those defects are improved with the least decrease in developing rate.

In Japanese Patent Publication Open to Public Inspection (hereinafter abbreviated "Japanese Patent O.P.I. Publication") No. 103725/1978, J. E. Maskasky discloses that an emulsion exhibiting the developing speed of silver chloride and high sensitivity can be materialized by preparing an emulsion making use of silver chloride crystals brought in epitaxial junction with silver iodide crystals. Though this emulsion maintains the developing speed of silver chloride, it has such a demerit that in the ordinary processing for color development the silver utilization (the percentage of the silver quantity in the coating that is developed) is low. It also has another demerit that because of the presence of a large quantity of silver iodide it is difficult to perform desilvering fully in the bleach-fix bath.

In Japanese Patent Examined Publication No. 36978/1975, Evans discloses a silver halide color photographic material making use of emulsions prepared by the conversion process. His Patent mentions about an emulsion containing only up to 50 mol % of silver chloride and it is concerned in an art that is related to a silver bromide based emulsion that is improved by incorporating physical defects by a conversion process, or by hybridizing silver bromide with silver chloride. Therefore, his invention should be clearly differentiated from the present invention.

In recent years, faster and more automatic processing of the silver halide color photographic material is increasingly demanded. Also to comply with such demand, development of an emulsion that is endowed with the higher developing rate of silver chloride, highly sensitive, stable in storage and no increase in fog by contamination of developer with sodium thiosulfate is being wished for but with the prior art it has been impossible to satisfy such wish.

Accordingly, it is an object of the present invention to provide an emulsion of silver halide of high chloride content for the photographic material that can be processed faster and has improved sensitivity.

It is another object of the invention to provide a silver halide color photographic material that can be processed faster and exhibits higher reproducibility in the chemical ripening It is another object of the invention to provide a color photographic material that can be processed faster and is made more suitable to the processing in the automatic processor by substantially suppressing increase in fog even under contamination of the developer with sodium thiosulfate.

It is still another object of the invention to provide a negative type silver halide color photographic material having improved photographic characteristics, and particularly that for color paper.

As a result of energetic studies made by the present inventors, it was found that above objects can be achieved by use of silver halide color photographic material comprising on a support thereof at least one emulsion layer containing silver halide grains of high chloride content wherein each silver halide grain of said silver halide grains has on the surface thereof a layer mainly composed of silver bromide and 90 to 99.5 mol % of the entire silver halide composed of said grains is silver chloride and 0.5 to 10 mol % of those is silver bromide.

Silver halide grains according to the present invention are characterized by silver bromide comprised in said silver halide grains being localized on their surface and by having high chloride content.

These grains may be loaded with silver iodide, as necessary, through up to 1.0 mol % at most of the entire silver halide.

The layer mainly comprising silver bromide as mentioned above may be a covering uniformly or partially spread over the entire surface of silver halide cores mainly composed of silver chloride, or a one provided in epitaxial junction with such surface. Uniform spread of layer is preferable.

The layer mainly composed of silver bromide, which means that not less than 60 mol % of silver halide of that layer is accounted for by silver bromide, preferably not less than 80 mol % of that is accounted for by silver bromide and the most preferably silver halide of that layer is pure silver bromide.

The interface between such layer primarily composed of silver bromide and other layer or layers may be a definite phase boundary or it may have a thin transient region. In case a thin transient region is provided, the mixing raito of the silver halide mixture that is supplied after formation of a layer or core mainly comprising silver chloride may be continuously changed, for example, by using an apparatus as described in West German Pat. No. 2,921,164 or the concentration of excess halide ion may be controlled to make use of the so-called recrystallizing process For the silver halide grains according to the present invention, 0.5 to 10 mol % of the entire silver halide of these grains is accounted for by silver bromide. This silver bromide need not be limited to the layer primarily composed of silver bromide located in the surface of silver halide grains but it may present partially in an internal of said silver halide grains, though it is preferable that almost all of the silver bromide is present in the surface of grains. It is particularly preferable that the silver bromide that is contained in the layer primarily comprising silver bromide in the surface of grains accounts for 0.5 to 5 mol % of the entire silver halide of these grains.

The silver halide photographic emulsion thus prepared is improved in sensitivity as compared to the silver chloride emulsion while maintaining the developing rate at a level suitable to quick processing. Further, it exhibits suppression of fog and an improvement in stability in storage. In addition, its chemical ripening proceeds at a more moderate pace extending the practicable range of the degree of chemical ripening, so the reproducibility of the chemical ripening process sharply improves and increase in fog is suppressed remarkably in case of contamination of the developer with sodium thiosulfate. The achieved effects were thus surprising in view of the amount of silver bromide used and higher developing rate.

The emulsion as related to the present invention is preferably used as the so-called "surface latent image type emulsion" that forms the latent image primarily in the surface of grains. The term "surface latent image type emulsion" is a term that is opposed in concept to another term "internal latent image type emulsion" that is defined, for example, in Japanese Patent O.P.I. Publication No. 32814/1972. For the negative type silver halide color photographic material, the photo image of practical use is formed by increasing the image density with the energy of light empinging to the material. It is a matter of course that even such photographic material is subject to the so-called "solarization", a phenomenon of reversal under excessive exposure. However, this presents no problem, for this is a phenomenon that occurs under an exposure that is larger than the levels that are practically used.

The silver halide that can be preferably used in the present invention may have in its surface the (100) plane, (111) plane or both of them.

Silver halide grains used in the present invention may have grain sizes that are within the range of normal use. The mean grain size between 0.05 μm to 1.0 μm is preferable. Both the narrow and wide grain size distributions are acceptable though the emulsion having narrow grain size distribution is preferable for use.

Silver halide grains used in the present invention can be prepared by methods normally used in the industry. These methods are described, for example, in a text edited by Mees and James, "The Theory of Photographic Process", MacMillan Press. The ammoniacal emulsion making process, neutral or acid emulsion making process and various other processes of general acceptance can be used for preparation.

For the mixing method of the halide salt and silver salt, any of the single-jet method and double-jet method as described in Chapter 3 of "Shashin Kogaku No Kiso—Gin-en Shashin Hen" (Basis of Photographic Technology—Part 'Silver Salt Photography'; Corona Press) as written by Akira Hirata and compiled by The Society of Scientific Photography of Japan can be used though the conversion method is applicable for the formation of the layer primarily composed of silver bromide. For the preparation of silver halide grains as related to the present invention, the double-jet method by which the halide salt solution and silver salt solution are simultaneously put into a reaction vessel to prepare silver halide grains under presence of a suitable protective colloid is particularly preferable for use. Among versions of the double-jet method, the so-called "balanced double jet method" by which mixing is performed while the feeding rates of the halide salt solution and silver salt solution are adjusted to maintain the pAg in a certain range is more preferable. Not only the pAg but also the pH and temperature are preferably controlled at their proper levels during precipitation. As far as the formation of the layer primarily comprising silver bromide is concerned, the so-called "conversion method" by which a bromide salt solution is added after all the amount of silver salt to be used for the reaction is added, for example, by the double-jet method is preferably used.

For the preparation of silver halide, the pH level is adjusted preferably between 2.0 and 8.5 and particularly preferably between 3.0 and 7.5. The pAg level changes somewhat depending on individual steps of silver halide grain preparation and silver halide composition. For the preparation of silver halide grains of high chloride content, it is preferably adjusted between 6.0 and 8.5 and particularly preferably between 7.0 and 8.0. For the formation of the layer primarily comprising silver bromide by double-jet method, a condition pAg=7.0 to 10.0 is preferable. A pAg value between 8.0 and 9.0 is particularly preferable.

Various systems have been proposed for the preparation of such silver halide grains. For example, Japanese Patent Examined Publication No. 21045/1973 describes a method by which a fast precipitation reaction is performed under strong agitation in a comparatively small precipitation chamber and physical ripening is performed in a ripening chamber of very large volume with the dispersion fluid formed therein recycled to the precipitation chamber for use as the medium for the precipitation of silver halide, while Japanese Patent Examined Publication No. 48964/1974 describes a method by which in a precipitation chamber sunk in a reaction vessel the silver salt solution and halide salt solution are introduced into the solution in the vessel at different points thereof for dilution and then mixed for fast precipitation, and dispersed precipitates are discharged outside of the precipitation chamber for physical ripening in the outer compartment of reaction vessel with the dispersion fluid recycled to the same precipitation chamber for use as the medium for silver halide precipitation. For preparation of the silver halide emulsion as related to the present invention, the above systems are particularly preferable for use.

The silver halide emulsion can be used regardless of whether it has been subjected to physical ripening or not. After formation of precipitates or physical ripening, usually, soluble salts are removed from the emulsion. As a means to achieve the above, there can be used the noodle washing method that has been known since long or the method that makes use of an inorganic salt having a multivalent anion, for example, ammonium sulfate, magnesium sulfate, etc., anionic surfactant, polystyrenesulfonic acid or other anionic polymer, or gelatin derivative, for example, aliphatic- or aromatic-acylated gelatin.

The emulsion as related to the present invention primarily uses gelatin for the protective colloid. Particularly, inactive gelatin is preferable. Further, instead of gelatin, a photographically inactive gelatin derivative, such as phthalo derivative of gelatin or the like, or water-soluble polymer, such as polyvinyl alcohol, polyvinyl pyrrolidone, carboxymethyl cellulose, hydroxymethyl cellulose, or the like, may be used.

The silver halide emulsion used in the present invention preferably undergoes chemical ripening by a method ordinarily practiced in the industry. For example, methods as described in the aforementioned Mees' text "The Theory of Photographic Process" and others or various other known methods can be used. Namely, the following sensitization methods may be used independently or in combination: The sulfur sensitization method that makes use of a compound containing a sulfur atom or atoms reactive with the silver ion, for example, a thiosulfate or one of compounds as mentioned in U.S. Pat. Nos. 1,574,944, 2,278,947, 2,410,689, 3,189,458, 3,501,313, and French Pat. No. 2,059,245, or active gelatin; the reduction sensitization method making use of a reducing agent, for example, a stannous salt as disclosed in U.S. Pat. No. 2,487,850, one of amines in U.S. Pat. Nos. 2,518,698, 2,521,925, 2,521,926, 2,419,973, and 2,419,975, an iminoaminomethanesulfinic acid in U.S. Pat. No. 2,983,610, or a silane compound in U.S. Pat. No. 2,694,637, or the one that relies on the method of H. W. Wood as mentioned in Journal of Photographic Science, Volume 1, pp. 163- (1953); the gold sensitization method making use of a gold complex salt or gold thiosulfate complex salt in U.S. Pat. No. 2,399,083; or a sensitization method making use of one of those salts of precious metals, such as platinum, palladium, iridium, rhodium, and ruthenium, that are disclosed in U.S. Pat. Nos. 2,448,060, 2,540,086, 2,566,245, and 2,566,263. Further, instead of or in combination with the sulfur sensitization method, the selenium sensitization method as disclosed in U.S. Pat. No. 3,297,446 can be applied.

The silver halide emulsion as related to the present invention can be spectrally sensitized, depending on its intended use, by sensitizing dyes capable of sensitizing the emulsion in various spectral ranges. These sensitizing dyes are mentioned in texts, for example, in the above cited Mees & James compiled book "The Theory of Photographic Process", 3rd edition, MacMillan Press, and James edited book "The Theory of Photographic Process", 4th edition, MacMillan Press, and they are accepted generally. Cyanine dyes, merocyanine dyes, hemicyanine dyes may be used independently or in combination.

The optimum concentration of a sensitizing dye to be used may be determined by a method wherein the same emulsion is divided into fractions by a method known to the industry and individual fractions are loaded with different concentrations of the sensitizing dye for estimation of their sensitivity. Though not limited, it is advantageous to use an amount of sensitizing dye between about $2\times10^{-6}$ and about $1\times10^{-3}$ mol per mol of silver halide.

These sensitizing dyes may be added at any time during the manufacturing process of the emulsion. Addition during or after chemical ripening is preferable. For addition, any method well-known in this field of technology may be used. A method that is normally often used is to add them in the form of solutions that are prepared by dissolving them either into water-soluble solvent, for example, pyridine, methyl alcohol, ethyl alcohol, methyl cellosolve, acetone, or their mixture and diluting the resultant solution with water, as necessary, or into water in some cases. However, it is also possible to use a method as disclosed in U.S. Pat. No. 3,469,987 wherein a dye, dissolved into a volatile organic solvent, is dispersed into hydrophilic colloid and the resultant dispersed solution is added to the emulsion or a method as disclosed in Japanese Patent Examined Publication No. 24185/1971 wherein a water-insoluble dye is not dissolved but dispersed into a water-soluble solvent and the resultant dispersed solution is added to the emulsion. Other methods to add dyes to the emulsion as disclosed in U.S. Pat. Nos. 2,912,345, 3,342,605, 2,996,287, and 3,425,835 may also be used.

The photographic emulsion as related to the present invention may be loaded with a compound or compounds, for example, a tetrazaindene or mercaptotetrazole in an aim to prevent fogging of the photographic material during its storage or processing and/or stabilize its photographic performance.

The photographic material of the present invention may be the so-called coupler-in-emulsion-type photographic material with a built-in coupler system or the coupler-in-developer-type photographic material to which the necessary coupler or couplers are to be added during processing for development.

For the coupler that can be loaded to the color photographic material embodying the present invention, any compound that can undergo a coupling reaction with the oxidized form of developing agent to form a coupling product exhibiting the maximum spectral absorption at a wavelength longer than 340 nm can be used. Typical examples of such compound are cited below.

For the coupler capable of forming a coupling product that exhibits the maximum spectral absorption in a spectral range between 350 and 500 nm, those compounds that the known as yellow couplers in the industry are typical examples. They are mentioned, for example, in U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, 3,894,875, British Pat. Nos. 778,089, 808,276, 875,476, 1,402,511, 1,421,126, 1,513,832, Japanese Patent Examined Publication No. 13576/1974, Japanese Patent No. O.P.I. Publication Nos. 29432/1973, 66834/1973, 10736/1974, 122335/1974, 28834/1975, 132926/1975, 138832/1975, 3631/1976, 17438/1976, 26038/1976, 26039/1976, 50734/1976, 53825/1976, 75521/1976, 89728/1976, 102636/1976, 107137/1976, 117031/1976, 122439/1976, 143319/1976, 9529/1978, 82332/1978, 135625/1978, 145619/1978, 23528/1979, 48541/1979, 65035/1979, 133329/1979, and 598/1980.

For the coupler capable of forming a coupling product that exhibits the maximum spectral absorption in a spectral range between 500 and 600 nm, compounds that are known as magenta couplers in the industry are typical examples. They are mentioned, for example, in U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 3,214,437, 3,253,924, 3,311,476, 3,419,391, 3,486,894, 3,519,429, 3,558,318, 3,617,291, 3,684,514, 3,705,896, 3,725,067, 3,888,680, British Pat. Nos. 720,284, 737,700, 813,866, 892,886, 918,128, 1,019,117, 1,042,832, 1,047,612, 1,398,828, 1,398,979, West German Pat. Nos. 814,996, 1,070,030, Belgian Pat. No. 724,427, Japanese Patent O.P.I. Publication Nos. 60479/1971, 29639/1974, 111631/1974, 129538/ 1974, 13041/1975, 116471/1975, 159336/1975, 3232/1976, 3233/1976, 10935/1976, 16924/1976, 20826/1976, 26541/1976, 30228/1976, 36938/1976, 37230/1976, 37646/1976, 39039/1976, 44927/1976, 104344/1976, 105820/1976, 108842/1976, 112341/1976, 112342/1976, 112343/1976, 112344/1976, 117032/1976, 126831/1976, 31738/1977, 9122/1978, 55122/1978, 75930/1978, 86214/1978, 125835/1978, 123129/1978, and 56429/1979.

For the coupler capable of forming a coupling product that exhibits the maximum spectral absorption in a spectral range between 600 and 750 nm, compounds that are known as cyan couplers in the industry are typical examples. They are mentioned, for example, in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,330, 3,446,622, 3,476,563, 3,737,316, 3,758,308, 3,839,044, British Pat. Nos. 478,991, 945,542, 1,084,480, 1,377,233, 1,388,024, 1,543,040, Japanese Pat. O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, and 32071/1980.

For the coupler capable of forming a coupling product that exhibits the maximum spectral absorption in a spectral range between 700 and 850 nm, examples are given in Japanese Patent Examined Publication No. 24849/1977, Japanese Patent O.P.I. Publication Nos. 125836/1978, 129036/1978, 21094/1980, 21095/1980, and 21096/1980.

For the silver halide color photographic material embodying the present invention, generally, each silver halide photographic emulsion is used with a coupler as mentioned above, preferably contained in the same layer as the emulsion. To load the photographic material with these couplers, they are dispersed into a hydrophilic colloid by a technically effective dispersion method. For such dispersion method, various known methods can be used. A dispersion method by which a coupler is dissolved into a practically water-insoluble solvent of high boiling point and then dispersed into a hydrophilic colloid is preferably used. Examples of the particularly useful solvent of high boiling point are N-n-butylacetanilide, diethyllauramide, dibutylauramide, dibutyl phthalate, dioctyl phthalate, tricresyl phosphate, N-dodecylpyrrolidone, etc. To facilitate dissolution in the above method, a solvent of low boiling point or an organic solvent readily soluble in water may be used. For the solvent of low boiling point, ethyl acetate, methyl acetate, cyclohexanone, acetone, methanol, ethanol, tetrahydrofuran, etc., may be used while for the organic solvent readily soluble in water, 2-methoxyethanol, dimethylformamide, etc. may be used. These solvents of low boiling points and organic solvents readily soluble in water can be removed by washing with water or by coating and drying.

Further, the silver halide color photographic material embodying the present invention can be loaded with various other additives used for photography, for example, known hardening agent, spreading agent, ultraviolet absorbing agent, brightening agent, physical property improving agents, such as wetting agent and polymer dispersed in water, and condensation product between a phenol and formalin.

Furthermore, the silver halide photographic emulsion as related to the present invention is generally coated and dried over a proper base to provide a silver halide color photographic material. Applicable to such base is a base material made of paper, glass, cellulose acetate, cellulose nitrate, polyester, polyamide, polystyrene, or the like, or one made by pasting two or more different base materials, for example, laminate between paper and polyolefin, such as polyethylene, polypropylene, or the like. In order to improve the adhesibility of the silver halide emulsion, such base is generally variously treated to provide an improved surface. For example, a base surface treated by electron bombardment or subbed to provide a subbing layer can be used.

As for coating and drying of the silver halide photographic emulsion on such base, the material is coated by a generally known coating method, for example, dip coating, roller coating, multi-slide hopper coating, curtain flow coating, or the like, and then dried.

The silver halide color photographic material embodying the present invention has a basic construction as mentioned above. Actually, however, it is formed by combining various constituent layers of photographic material as selected from blue-, green- and red-sensitive emulsion layers, intermediate layer, protective layer, filter layer, antihalation layer, backing layer, etc. according to the need, wherein each sensitive emulsion layer may be composed of double layers that differ in the sensitivity of emulsion The silver halide color photographic material having the silver halide emulsion as related to the present invention can be processed by a known method after exposure. The processing temperature and time are properly set. The temperature may be set to room temperature or a temperature lower than that, for example, below 18° C., or a temperature higher than the room temperature or above 30° C., for example around 40° C. or even above 50° C.

For the color developing agent used in the color photographic processing, for example, sodium salts of N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxy, methyl-2-methyl-p-phenylenediamine, N-carbamidomethyl-N-ethyl-2-methyl-p-phenylenediamine, N-ethyl-N-tetrahydrofurfuryl-2-methol-p-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, N-methyl-N-$\beta$-sulfoethyl-p-phenylenediamine can be used.

For the color photographic material embodying the present invention, these color developing agents may be loaded into hydrophilic colloid layers as they are or in the form of their precursor for development of the material in an alkaline activation bath. The precursor of a color developing agent is a compound that produces such color developing agent in alkaline condition. Examples of such precursor are the precursor of Schiff base type comprising an aromatic aldehyde derivative, multivalent metal ion complex type precursor, phthalimide derivative type precursor, phosphamide derivative type precursor, sugar-amine reaction product type precursor, urethane type precursor, etc. These precursors of primary aromatic amine color developing agents are mentioned, for example, in U.S. Pat. Nos. 3,342,599, 2,507,114, 2,695,234, 3,719,492, British Pat. No. 803,783, Japanese Patent O.P.I. Publication Nos. 185628/1978, 79035/1979, and in a journal "Research Disclosure", Nos. 15159, 12146, and 13924.

Each of these primary aromatic amine color developing agents or their precursor must be added in a quantity that will result in full color development by itself when treated for activation. This quantity changes considerably depending on the type of photographic material. In most cases, however, a quantity between 0.1 and 5 mol per mol of silver halide, and preferably between 0.5 and 3 mol per mol of silver halide is used. The above color developing agents or their precursor can be used independently or in combination. To load into a photographic material, they can be dissolved in a proper solvent, such as water, methanol, ethanol, or acetone, for addition or they can be dissolved into an organic solvent of high boiling point, such as dibutyl phthalate, dioctyl phthalate, or tricresyl phosphate, and dispersed into a hydrophilic colloid, for addition. It is also possible to impregnate latex polymer with them for addition as mentioned in "Research Disclosure", No. 14850.

Development is followed by bleaching and fixing, which can be conducted simultaneously. Many compounds are used for the bleaching agent. Among others, multivalent metal compounds, for example, ferric, cobaltic and cupric compounds, and particularly complex salts between multivalent metal cations and organic acids, for example, aminopolycarboxylic acids including ethylenediaminetetraacetic acid, nitrilotriacetic acid and N-hydroxyethylethylenediaminediacetic acid, malonic acid, tartaric acid, malic acid, diglycollic acid, and dithioglycollic acid, ferricyanate salts, bichromate salts, etc. may be used independently or in combination.

Preparation of Control Emulsion I—Pure silver chloride emulsion 1 liter of 1 mol/liter silver nitrate solution and 1 mol/liter sodium chloride solution were added over 50 min. by measuring pumps to 700 ml of 4% aqueous gelatin solution containing 6 g of sodium chloride while the pAg being maintained at a level of 7.7. Washing and desalination were then conducted by the following process.

As precipitants, aqueous 5% Demol N (supplier: Kao Atras) solution and aqueous 20% magnesium sulfate solution were added in a ratio of 10:9 until precipitation occurs. After the solution is left to stand to allow floating precipitates to come down to the bottom, the supernatant was decanted and then 3 liter of distilled water was added to the precipitates for redispersion. Aqueous 20% magnesium sulfate solution was added until precipitation occurs again. After the solution being left to stand, the supernatant was decanted. Thereafter, aqueous gelatin solution was added and after agitation for 20 min. at 40° C. for redispersion aqueous sodium chloride solution was added to adjust for pAg=7.6. At the same time distilled water was added to adjust the volume of the emulsion. The resultant emulsion had a gelatin concentration of 5% and a volume of 560 ml. This emulsion was called Em-1. Observation by electronmicroscopy showed that this emulsion had a mean grain size of 0.4 $\mu$m.

Preparation of Control Emulsion II—Silver chlorobromide emulsion uniformly loaded with silver bromide 1 liter of 1 mol/liter silver nitrate solution and mixed solution of sodium chloride and potassium bromide (containing 0.95 mol of sodium chloride and 0.05 mol of potassium bromide per liter of solution) were added over 60 min. by measuring pumps to 700 ml of 4% aqueous gelatin solution containing 5.9 g of sodium chloride and 0.07 g of potassium bromide while the pAg being maintained at 7.9 by adding the aqueous mixed halide salt solution through a separate route Next, washing with water and desalination were performed by the same process as applied to the Preparation of Control Emulsion I. The pAg and volume of resultant emulsion were adjusted to 7.6 and 560 ml, respectively. This emulsion was called Em-2. Observation by electronmicroscopy showed that this emulsion had a mean grain size of 0.4 μm.

Preparation of Control Emulsion II—Silver halide emulsion comprising silver halide grains with silver bromide localized in their surface in an amount higher than the range defined by the present invention 1 liter of 1 mol/liter silver nitrate solution and 1 mol/-liter sodium chloride solution were added over 50 min. by measuring pumps to 700 ml of 4% aqueous gelatin solution containing 6 g of sodium chloride while the pAg being maintained at a level of 7.7. Next, an aqueous solution containing 17.9 g of potassium bromide was added over 10 min. Thereafter, washing with water and desalination were conducted by the same process as applied to Preparation of Control Emulsion I. The resultant emulsion was redispersed into aqueous gelatin solution and the pAg and volume were adjusted to 7.6 and 560 ml, respectively. It was called Em-3. Observation by electronmicroscopy showed that this emulsion had a mean grain size of 0.4 μm.

EXAMPLE 1

A silver halide emulsion Em-4 embodying the present invention was prepared by the same process as the Preparation of Control Emulsion III except that the quantity of potassium bromide was reduced from 17.9 to 6.0 g. Observation by electronmicroscopy showed that this emulsion had a mean grain size of 0.4 μm.

100 ml sample emulsion of Em-1, -2, -3 and -4 were subjected to chemical ripening by a routine method after addition of $3.6\times10^{-6}$ mol of sodium thiosulfate. Differences in the rate of chemical ripening between different samples were removed by adjusting the ripening temperature. 5 min before termination of such chemical ripening, a sensitizing dye GS-1* was added in a quantity of $3.0\times10^{-4}$ mol per mol of silver halide. When the ripening was terminated, a stabilizer ST-1 was added in a quantity of 1 g per mol of silver halide. Next, 0.25 mol of a magenta coupler MC-1* per mol of silver halide and 0.15 mol of a color stain preventing agent AS-1**** per mol of such coupler were added after they were simultaneously dissolved into tricresyl phosphate, and dispersed into a hydrophilic colloid (hereinafter abbreviated "TCP").

*GS-1: Anhydro-5,5'-diphenyl-9-ethyl-3,3'-di-(γ -sulfo-propyl) oxacarbocyanine hydroxide

**ST-1: 4-hydroxy-6-methyl-1,3,3a,7-tetrazaindene

***MC-1: 3-[2-chloro-5-(1-octadecenylsuccinimido)-anilino]-1-(2,4,6-trichlorophenyl)-5-pyrazolone

****AS-1: 2,5-di-t-octylhydroquinone

Photographic base paper that was coated with polyethylene loaded with the anatase type titanium dioxide was coated with the above emulsion samples to have 0.40 g silver/$m^2$ of base and 3.0 g gelatin/$m^2$ of base. Further, 2 g gelatin/$m^2$ was additionally applied to provide a protective layer. This protective layer contained bis(vinylsulfonylmethyl)ether as the hardening agent and saponine as the spreading agent.

The test photographic materials thus prepared were exposed through an optical wedge to yellow light (filter Wratten No. 12 supplied by Eastman Kodak) using the sensitometer Model KS-7 (supplied by Konishiroku Photo Industry) and then processed in the color developer CD-1 as described below.

The reflection density from each of magenta dye formed in individual test materials was measured by Sakura Color Densitometer Model PDA-60 (supplied by Konishiroku Photo Industry) through a green filter attached thereto.

| | | |
|---|---|---|
| [Processing steps] | | |
| Color development | 33° C. | 1 min |
| Bleach-fixing | 33° C. | 1½ min |
| Washing | 30 to 34° C. | 3 min |
| Drying | | |
| [Formulation of color developing solution CD-1] | | |
| Pure water | | 800 ml |
| Ethylene glycol | | 12 ml |
| Benzyl alcohol | | 12 ml |
| Anhydrous potassium carbonate | | 30 g |
| Anhydrous potassium sulfite | | 2.0 g |
| N—ethyl-N—(β-methanesulfonamido) ethyl-3-methyl-4-aminoaniline sulfuric acid salt | | 4.5 g |
| Adenine | | 0.03 g |
| Sodium chloride | | 1.0 g |
| Potassium hydroxide or sulfuric acid added for pH = 10.2 | | |
| Pure water added to make up for | | 1 liter |
| [Formulation of the bleach-fixing solution] | | |
| Pure water | | 750 ml |
| Sodium ethylenediaminetetraacetate ferrate (III) | | 50 g |
| Ammonium thiosulfate | | 85 g |
| Sodium bisulfite | | 10 g |
| Sodium metabisulfite | | 2 g |
| Disodium ethylenediaminetetraacetate | | 20 g |
| Sodium bromide | | 3.0 g |
| Pure water added to make up for | | 1 liter |
| Ammonia water or sulfuric acid added for pH = 7.0 | | |

FIG. 1 shows how the characteristic curve of Em-1 changed in the course of chemical ripening.

Curve 1 represent the same characteristic curve of the Em-1 without any chemical ripening. First, there was sensitization at the low density region of characteristic curve (Curve 2). There was then sensitization in the medium and high density regions (Curve 3). Finally, the gradation of the emulsion before chemical ripening was almost recovered (Curve 4). At this time, the maximum sensitivity was reached and the fog level started to increase. The emulsion exhibiting Curve 3 is not applicable to practical use.

FIG. 2 shows how the characteristic curve of Em-4 changed in the course of chemical ripening.

Since the chemical ripening proceeded remarkably faster with Em-4, the ripening temperature was lowered for adjustment. As compared to Em-1, the curve changed moderately as a whole and, by contrast to Em-1, no induction period was observed. Further, even after the maximum sensitivity was reached, there was no noticeable move in fogging. Namely, in the course of chemical ripening, the intensification of fog was well separated in timing from changes in sensitivity, resulting in a wider practicable range of chemical ripening and good reproducibility.

Table 1 summarizes data on fogging and sensitivity. For sensitivity, there are given relative values that were estimated by comparing to the sensitivity of Em-1 that was 100. In 1 min development in CD-1, Em-3 failed to develop fully and no estimation could be made with it. For this sample, therefore, data that resulted from 3½ min development were given in parentheses instead.

TABLE 1

| | Em-1 (control) | Em-2 (control) | Em-3 (control) | Em-4 (invention) |
|---|---|---|---|---|
| AgBr content | 0 mol % | 5 mol % | 15 mol % | 5 mol % |
| Sensitivity | 100 | 110 | (145) | 132 |
| Fog | 0.13 | 0.10 | (0.15) | 0.04 |

The silver halide emulsion as related to the present invention showed an improvement in sensitivity and it is seen that fog was low. The merits of the invention are fully recognized even when compared to the control emulsion Em-2 with uniform distribution of silver bromide.

Table 2 gives performance data exhibited by the above emulsions after storage at hot condition (2 days at 55° C.). For sensitivity, there are given relative values that were estimated by comparing to the sensitivity of individual emulsions not subjected to such storage, which was set to 100. As in Table 1, data for Em-3 were those that resulted from 3.5 min development in CD-1.

TABLE 2

| | Em-1 (control) | Em-2 (control) | Em-3 (control) | Em-4 (invention) |
|---|---|---|---|---|
| Sensitivity | 140 | 132 | (106) | 110 |
| Fog | 0.30 | 0.26 | (0.20) | 0.11 |

A problem of the silver halide emulsion of high chloride content has been that there are increased fog and large changes in sensitivity when the sample is stored at high temperatures. It is found that the silver halide emulsion as related to the present invention shows improvements in these respects. It will also be understood from Table 2 that the degree of these improvements is not so much different from Em-3 that showed much lower developing rate and that there are distinct merits of the present invention even in comparison to Em-2 uniformly loaded with silver bromide.

One of the defects of the silver halide emulsion of high chloride content is that chemical ripening causes unique changes in the characteristic curve. For this reason, the practicable range of chemical ripening is much narrowed resulting in poor reproducibility. As known from FIGS. 1 and 2, however, the silver halide emulsion embodying the invention shows a remarkable improvement resulting in good reproducibility.

Another defect of the silver halide emulsion of high chloride content is its low sensitivity. As seen from Table 1, this weak point improves and further fog is suppressed.

Besides, still another defects of silver halide emulsion of high chloride content are increased fog and much changes in sensitivity when the coating sample is stored at hot condition. Table 2 shows substantial improvements also at these points.

It has been found that these weak points of the silver halide emulsion of high chloride content are much improved with the silver halide emulsion of the present invention. Let us now check what developing rate are exhibited by the emulsion having such high improvements.

EXAMPLE 2

A test sample was prepared by the same method as in Example 1 except for use of triacetyl cellulose film base.

FIG. 3 is the transmission density measured from the area of maximum density versus logarithmic plots of the developing time. The former parameter was estimated as relative values by comparing to the transmission density as estimated for a developing time of 3.5 min, which was set to 100.

The silver halide emulsion Em-4 as related to the present invention exhibited a high developing rate enough to suit to the purpose of quick processing though there were slight declines in such developing rate as compared to the emulsion Em-2 uniformly loaded with silver bromide. The silver halide emulsion Em-3 that contained a quantity of silver bromide that exceeded the concentration range as defined by the present invention was useful, as shown by Table 1, with respect to sensitivity and fog but with its remarkably inferior developing rate, it was not suitable for quick processing.

EXAMPLE 3

Using the test samples prepared in Example 1, it was examined how contamination of the developer with sodium thiosulfate affected their performance in fog. Table 3 shows fog levels with samples processed in a developer CD-2 that were prepared by adding sodium thiosulfate at a concentration of 50 mg/1 to the developing solution CD-1.

TABLE 3

| | Em-1 (control) | Em-2 (control) | Em-3 (control) | Em-4 (invention) |
|---|---|---|---|---|
| Fog | 1.50 | 0.80 | 0.15 | 0.18 |

Contamination of the developer with sodium thiosulfate resulted in noticeable increase in fog in the pure silver chloride emulsion Em-1. The emulsion Em-2 uniformly loaded with silver bromide showed an improvement though it was quite unsatisfactory. As shown in Example 2, the silver halide emulsion Em-4 as related to the present invention was inferior, though slightly, to Em-2 in the developing rate but the former showed pronounced suppression of fog. Since processing in the automatic processor is unavoidably accompanied with this sort of contamination of the developer, the weak point of the silver halide emulsion of high chloride content as mentioned in the beginning in relation to fog could be a fetal demerit. However, the silver halide emulsion as related to the invention showed a satisfactory improvement in this respect, which was quite unexpected in consideration of the small degree of decline in the developing rate.

EXAMPLE 4—Emulsion coated with silver chlorobromide containing 80 mol % of silver bromide 1 liter of 1 mol/liter silver solution and 1 mol/liter sodium chloride solution were added at a rate of 20 ml per minute by measuring pumps to 700 ml of 4% aqueous gelatin solution containing 6 g of sodium chloride while the pAg being maintained at a level of 7.7 by properly adjusting the adding rate of sodium chloride. After addition for 47 min, the sodium chloride solution was exchanged for a mixed halide solution containing 0.8 mol of potassium bromide and 0.2 mol of sodium chloride per liter of solution. Both the mixted halide solution and silver nitrate solutions were then added at a rate of 10 ml per minute for 6 min. Washing and desalination were then conducted by the same process as described in "Preparation of Control Emulsion I", which were followed by redispersion into gelatin solution. The pAg and volume of the resultant emulsion were adjusted to 7.6 and 560 ml, respectively. This emulsion was called EM-5. Observation by electronmicroscopy showed that it had a mean grain size of 0.4 μm.

Another emulsion EM-6 was prepared by the same procedure as applied to EM-5 except that the initial preparation of silver chloride emulsion was performed for 47½ min and 1 mol/l potassium bromide solution was then added for 5 min. The pAg and volume of Em-6 were adjusted to 7.6 and 560 ml. Observation by electronmicroscopy showed that this emulsion had a mean grain size of 0.4 μm.

100 ml sample emulsions of Em-1 (silver chloride emulsion), Em-2 (uniformly loaded with silver bromide), Em-5 (silver chloride covered with silver chlorobromide containing 80 mol % of silver bromide), Em-6 (silver chloride covered with silver bromide), and Em-4 (silver chloride covered by the conversion method) were subjected to chemical ripening according to the method of Example 1. Table 4 shows results of their processing in CD-1 and CD-2.

TABLE 4

| | Em-1 (control) | Em-2 (control) | Em-5 (invention) | Em-6 (invention) | Em-4 (invention) |
|---|---|---|---|---|---|
| Sensitivity | 100 | 113 | 120 | 128 | 135 |
| Fog | 0.15 | 0.13 | 0.07 | 0.05 | 0.05 |
| Fog (CD-2 processing) | 1.35 | 0.83 | 0.30 | 0.19 | 0.20 |

Regardless of whether the layer primarily composed of silver bromide was made of silver chlorobromide containing 80 mol % of silver bromide (Em-5) or silver bromide (Em-4, 6), the emulsion of the present invention exhibited very superior performances in sensitivity and in fog even under a fog facilitating condition (contamination of developer with sodium thiosulfate).

EXAMPLE 5

1 liter of 1 mol/liter silver nitrate solution and 1 mol/liter sodium chloride solution were added over 80 min to 700 ml of 4% aqueous gelatin solution containing 1.5 g of sodium chloride and 64 mg of 1,8-dihydroxy-3,6-dithiaoctane at a rate that was properly changed within a range that did not produce any new grains, while an adjustment was being made for pH=3.0 with use of sulfuric acid. After the addition was completed, aqueous solution containing 3.6 g of potassium bromide was added over 10 min. Washing and desalination were then conducted by the same process as described in the Preparation of Control Emulsion I. After redispersion into gelatin solution, the pAg and volume of the resultant emulsion were adjusted to 7.6 and 560 ml, respectively. This emulsion was called Em-7. Observation by electronmicroscopy showed that this emulsion had a mean grain size of 0.7 μm.

Trichromatic color photographic materials were prepared by the following procedure.

Photographic paper base that was coated with polyethylene loaded with anatase type titanium dioxide was surface treated by exposure to corona discharges. Six layers as specified below were stacked thereon by multiple coating to provide a color photographic material for printing. Quantities of individual ingredients as given below were values per square meter. The quantity of silver halide was expressed as the quantity of silver.

Layer 1

Blue sensitive emulsion layer containing 0.45 g of blue sensitive emulsion (mean grain size: 0.70 μm), 1.47 g of gelatin, and 0.8 g of yellow coupler YC-1* and 0.015 g of color stain preventing agent AS-1 dissolved in 0.4 g of dibutyl phthalate (hereinafter abbreviated "DBP"); *YC-1: α-(1-benzyl-2,4-dioxo-3-imidazolidinyl)-α-pivalyl-2-chloro-5-[γ-(2,4-di-t-amylphenoxy)butanamido]-acetanilide;

Layer 2

First intermediate layer containing 1.03 g of gelatin, and 0.015 g of color stain preventing agent AS-1 dissolved in 0.03 g of DBP;

Layer 3

Green sensitive emulsion layer containing 0.40 g of green sensitive emulsion (mean grain size: 0.4 μm), 1.85 g of gelatin, and 0.63 g of magenta coupler MC-1, and 0.015 g of color stain preventing agent AS-1 dissolved in 0.34 g of TCP;

Layer 4

Second intermediate layer containing 1.45 g of gelatin, 0.2 g of ultraviolet absorber UV-1*, 0.3 g of another ultraviolet absorber UV-2**, and 0.05 g of color stain preventing agent AS-1 dissolved in 0.22 g of DBP;

*UV-1: 2-(2-hydroxy-3,5-di-t-butylphenyl)-benzotriazole
**UV-2: 2-(2-hydroxy-5-t-butylphenyl)-benzotriazole

Layer 5

Red sensitive emulsion layer containing 0.30 g of red sensitive emulsion (mean grain size: 0.4 μm), 1.6 g of gelatin, and 0.42 g of cyan coupler CC-1* and 0.005 g of color stain preventing agent AS-1 dissolved in 0.3 g of DBP;

*CC-1: 2-[2-(2,4-di-t-amylphenoxy)butanamido]-4,6-di-chloro-5-methylphenol

Layer 6

Protective layer containing 1.8 g of gelatin.

The silver halide emulsions used in this example were subjected to chemical ripening as specified below.

To prepare the silver halide emulsion used for the Layer 1, Em-7 was loaded with $1\times10^{-5}$ mol of sodium thiosulfate per mol of silver halide and then subjected to chemical ripening, a solution of sensitizing dye BS-1* prepared beforehand being added to the emulsion 5 min before termination of such chemical ripening and a stabilizer ST-1 being added at termination thereof.

*BS-1: 5-(3-ethyl-2-benzothiazolinylidene)-3-(β-sulfoethyl)-rhodanine.

The amount of BS-1 and ST-1 is $3.0\times10^{-4}$ mol per mol of silver halide and 1 g per mol of silver halide, respectively.

To prepare the silver halide emulsion used for the layer 3, the same method as applied to the emulsion of Layer 1 was used except that Em-4 of Example 1 was subjected to chemical ripening used $1.5\times10^{-5}$ mol of sodium thiosulfate per mol of silver halide and that $3.0\times10^{-4}$ of sensitizing dye GS-1 was used per mol of silver halide.

To prepare the silver halide emulsion used for the Layer 5, the same method as applied to the emulsion of Layer 3 was used except that $3.0\times10^{-4}$ mol of sensitizing dye RS-1** was used per mol of silver halide. Like Layer 3, Layer 5 used Em-4 for the silver halide emulsion.

**RS-1: 3,3-di-(β-hydroxyethyl)thiadicarbocyanine bromide

It is noted that beside the above mentioned ingredients, bis(vinylsulfonylmethyl)ether and saponine were added as the hardening agent and coating aid, respectively.

Sample 1 was thus prepared with use of the silver halide emulsions embodying the present invention.

Sample 2 was prepared under the same condition as applied to Sample 1 except that emulsion layers were individually replaced with a silver chlorobromide emulsion having a mean grain size of 0.70 μm and containing 15 mol % of silver chloride (blue sensitive emulsion layer), silver chlorobromide emulsion having a means grain size of 0.40 μm and containing 20 mol % of silver chloride (green sensitive emulsion layer), and silver chlorobromide emulsion having a mean grain size of 0.40 μm and containing 20 mol % of silver chloride (red sensitive emulsion layer).

Sample 3 was prepared under the same condition as applied to Sample 2 except that individual emulsion layers were replaced with emulsions of silver chloride, each having the same grain size as in Sample 2.

The above three samples of photographic materials were exposed across a color negative film to light for printing and processed for color development by the same process as described in Example 1. Samples 1 and 3 gave good color prints by a 1 min process for color development. Almost no image was developed in Sample 2 and particularly yellow color was missing. Sample 2 that was processed for 3.5 min in a developer (CD-3*) of conventional use, and Samples 1 and 3 as processed as above showed no lowering in chroma for the red and green colors up to the high density region. It was thus confirmed that a color paper used the silver halide emulsion as related to the present invention, is superior in color reproduction to the color paper used the silver chlorobromide primarily comprising silver bromide.

*CD-3: Same as the color developing solution CD-1 as described in Example 1 except that 0.5 g of potassium bromide was added thereto and adenine was removed therefrom. The developing temperature was the same as CD-1.

Further, this sample was divided into two and one was incubated under high temperature condition (2 days at 55° C.) and the other was kept under normal condition. Both were exposed through an optical wedge to compare them in sensitivity. The incubated sample was also processed in a developer CD-2 containing sodium thiosulfate to compare for fog. For sensitivity, relative values were indicated. Namely, for samples that had not been stored at high temperature, the sensitivity was estimated by comparing to the sensitivity of control Sample 3 that was 100, while for samples that had been stored at high temperature, the sensitivity was estimated by comparing to the sensitivity of the same samples that had not been stored at high temperature by assuming 100 for the latter.

TABLE 5

| | Sample 1 (invention) | | | Sample 3 (control) | | |
|---|---|---|---|---|---|---|
| | B | G | R | B | G | R |
| Without incubation: | | | | | | |
| Sensitivity | 127 | 130 | 130 | 100 | 100 | 100 |
| Fog | 0.06 | 0.05 | 0.04 | 0.10 | 0.08 | 0.05 |
| With incubation: | | | | | | |
| Sensitivity | 107 | 106 | 110 | 143 | 140 | 158 |
| Fog | 0.09 | 0.10 | 0.07 | 0.28 | 0.33 | 0.39 |
| CD-2 process: | | | | | | |
| Fog | 0.18 | 0.17 | 0.13 | 1.65 | 1.81 | 0.43 |

With use of the silver halide photographic emulsion as related to the present invention, fog was suppressed and sensitivities increased as compared to the control silver chloride emulsion. The former emulsion still maintained a sufficient developing rate to complete the image reproduction within the course of 1 min development though the developing rate was lower as compared to the silver chloride emulsion. Further, it would also be evident that changes in performances under storage at hot condition were small and that also in case of process in a developer contaminated with sodium thiosulfate increases in the fog level were suppressed small.

It would be thus readily understood that the silver halide color photographic material of the invention can be prepared without use of any special ingredient other than those that have been heretofore used in the silver halide photographic material, that it is endowed with the merits of silver chloride that a good image is developed in a 1 min treatment for color development without any lowering in chroma in pure colors, such as red or green colors, up to the high density range, and without requiring any particular changes in the developing condition, for example, an increase in the developing temperature; and yet that it is improved in the demerits of silver chloride, namely, lower sensitivity, poor preservation of raw stock, and remarkable increases in the fog level in case of process in a developer contaminated with a trace of thiosulfate ion.

Figure 1:
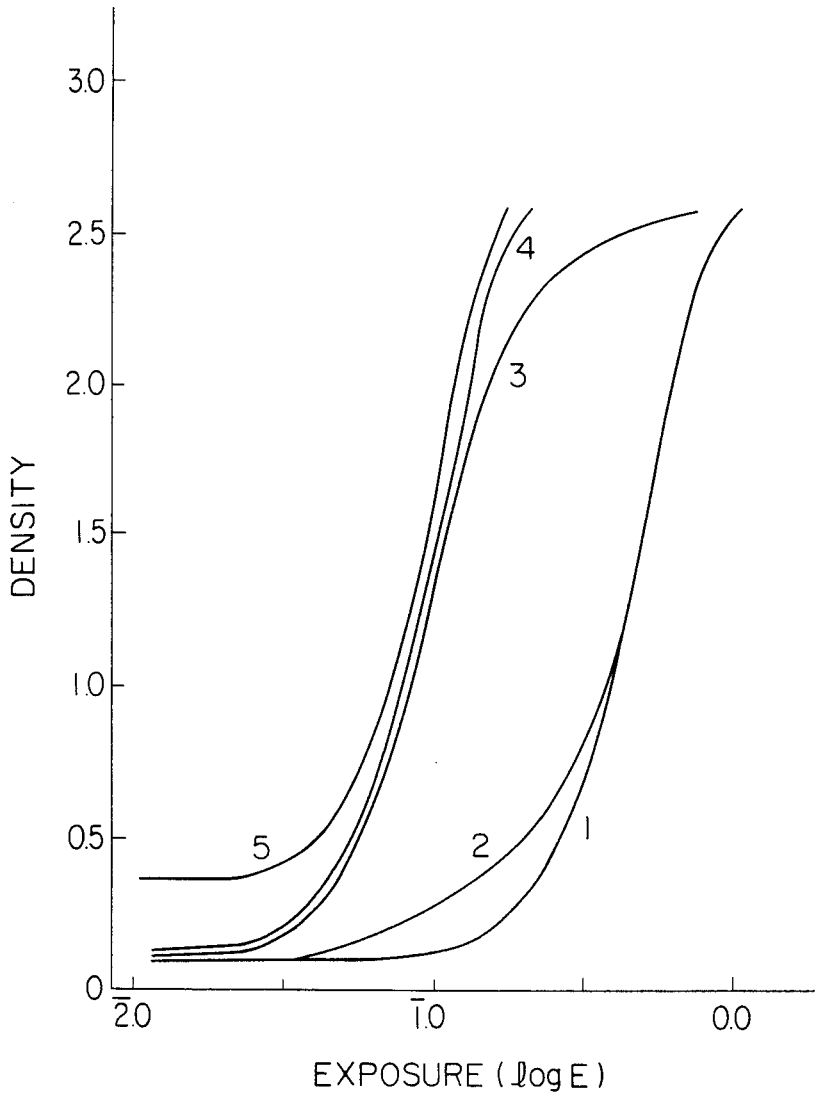
FIG. 1 shows changes in the characteristic curve of a silver chloride emulsion during chemical ripening. The numbers on individual curves indicate the following ripening times.
Figure 2:
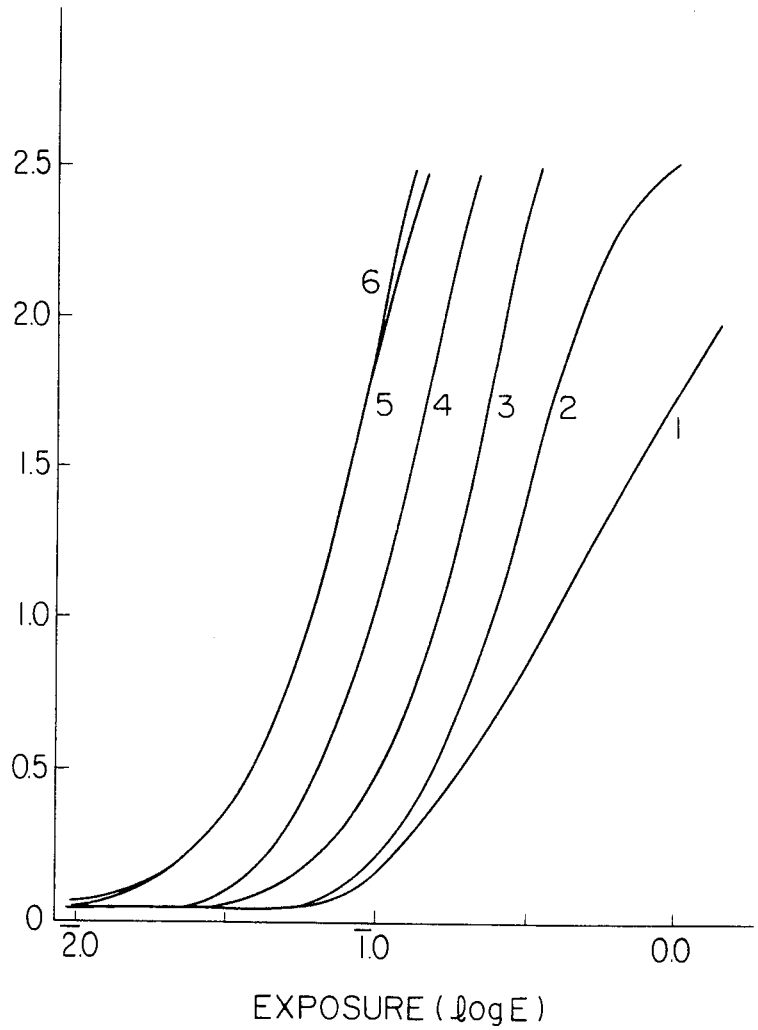

(1) Ripening time: 50 min;
(2) Ripening time: 70 min;
(3) Ripening time: 90 min;
(4) Ripening time: 100 min;
(5) Ripening time: 110 min;

FIG. 2 shows changes during chemical ripening in the characteristic curve of an emulsion comprising silver chloride grains whose surface was covered by the conversion method with a layer of silver bromide (silver bromide is 5 mol % of entire silver halide of these grains). The numbers on individual curves indicate the following ripening times:

(1) Ripening time: 0 min;
(2) Ripening time: 20 min;
(3) Ripening time: 60 min;
(4) Ripening time: 60 min;
(5) Ripening time: 80 min;
(6) Ripening time: 100 min.

Figure 3:
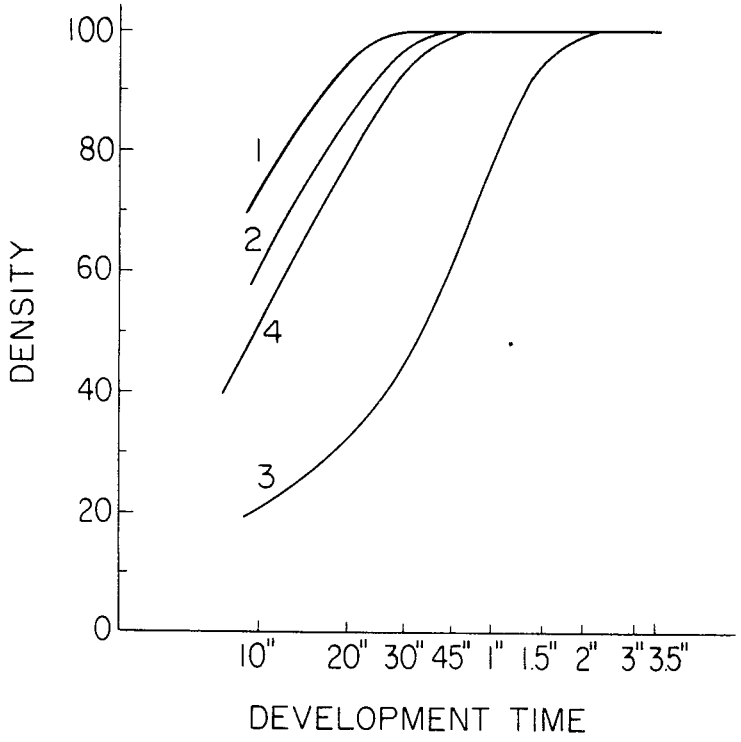

FIG. 3 is plots of the maximum transmission density versus developing time. The former parameter was estimated by comparing to the maximum transmission density attained by the 3½ min development assuming 100 for the latter. The numbers on the curves indicate the following emulsions:

(1) Silver chloride emulsion (control);

(2) Silver chlorobromide emulsion uniformly loaded with 5 mol % of silver bromide (control);

(3) Silver chlorobromide emulsion coated with a layer of silver bromide (silver bromide is 15 mol % of entire silver halide of these grains) (control); and (4) Silver chlorobromide emulsion coated with a layer of silver bromide (silver bromide is 5 mol % of entire silver halide of these grains) (invention).

What is claimed is:

1. A silver halide color photographic material comprising a support and an emulsion layer coated thereon, said emulsion layer comprising silver halide grains having silver halide core particles and a silver halide coating layer, said silver halide coating layer comprising at least 60 mol % silver bromide, and said silver halide core particles having a high chloride content, and wherein silver chloride comprises 90 to 99.5 mol % and silver bromide comprises 0.5 to 10 mol % of all of the silver halide present in said silver halide grains.

2. The material of claim 1 wherein said silver bromide is present in an amount of 0.5 to 5 mol % of the silver halide in said grains and all of said silver bromide is in said silver halide coating layer.

3. The material of claim 1 wherein said silver halide coating layer is at least 80 mol % silver bromide.

4. The material of claim 1 wherein said silver halide coating layer consists essentially of silver bromide.

5. The material of claim 2 wherein said silver halide coating layer is at least 80 mol % silver bromide.

6. A material according to claim 1, wherein said silver halide grains are chemically sensitized by means of sulphur sensitization.

7. The material of claim 2 wherein said silver halide coating layer consists essentially of silver bromide.

8. A material according to claim 7, wherein said silver halide grains are chemically sensitized by means of sulphur sensitization.

9. A material according to claim 2, wherein said silver halide grains are chemically sensitized by means of sulphur sensitization.

10. A material according to claim 3, wherein said silver halide grains are chemically sensitized by means of sulphur sensitization.

11. A material according to claim 4, wherein said silver halide grains are chemically sensitized by means of sulphur sensitization.

12. A material according to claim 5, wherein said silver halide grains are chemically sensitized by means of sulphur sensitization.

* * * * *